US006060441A

United States Patent [19]

Hessel et al.

[11] Patent Number: 6,060,441

[45] Date of Patent: May 9, 2000

[54] CLEANING COMPOSITIONS HAVING ENHANCED ENZYME ACTIVITY

[75] Inventors: J. Frederick Hessel, Doylestown; George A. Smith, Newtown; Charles B. Allen, East Norriton; Michael Hansberry, Plymouth Meeting, all of Pa.; Karl-Heinz Maurer, Erkrath, Germany

[73] Assignee: Henkel Corporation, Gulph Mills, Pa.

[21] Appl. No.: 08/833,878

[22] Filed: Apr. 10, 1997

[51] Int. Cl.[7] ..... C11D 1/29; C11D 1/835; C11D 1/72

[52] U.S. Cl. ..... 510/320; 510/321; 510/340; 510/351; 510/356; 510/358; 510/392; 510/421; 510/422; 510/497; 510/498

[58] Field of Search ..... 510/320, 321, 510/340, 351, 356, 358, 392, 421, 422, 497, 498

[56] References Cited

U.S. PATENT DOCUMENTS

| | | | |
|---|---|---|---|
| H1468 | 8/1995 | Costa et al. | 252/174.12 |
| 4,111,855 | 9/1978 | Barrat et al. | 252/153 |
| 4,318,818 | 3/1982 | Letton et al. | 252/174.12 |
| 4,404,115 | 9/1983 | Tai | 252/135 |
| 4,462,922 | 7/1984 | Boskamp | 252/174.12 |
| 5,332,528 | 7/1994 | Pan et al. | 252/548 |
| 5,476,608 | 12/1995 | Boyer et al. | 252/135 |
| 5,587,356 | 12/1996 | Dauderman et al. | 510/320 |
| 5,677,272 | 10/1997 | Ghosh et al. | 510/306 |
| 5,703,032 | 12/1997 | Bae-Lee et al. | 510/320 |
| 5,707,950 | 1/1998 | Kasturi et al. | 510/320 |

FOREIGN PATENT DOCUMENTS

| | | |
|---|---|---|
| 0739982 | 10/1996 | European Pat. Off. . |
| 283923 | 5/1915 | Germany . |
| 9117243 | 11/1991 | WIPO . |

OTHER PUBLICATIONS

Shell Chemical Co. Technical Bulletin SC:814–84, L. Kravetz, et al., "Effect of Surfactant Structure On Stability of Enzymes Formulated Into Laundry Liquids", Shell Dev. Co., Houston, Texas.

DelMar, et al., "A Sensitive New Substrate for Chymotrypsin", Analytical Biochemistry, 99, Academic Press, 1979, pp. 316–320.

Winkler, et al., "Glycogen, Hyaluronate, and Some Other Polysaccharides Greatly Enhance The Formation of Exolipase By *Serratia marcescens*", J. Bacterial., 138, 1979, pp. 663–670.

Lever, "A New Reaction For Colorimetric Determination of Cabohydrates", Analytical Biochemistry, 47, 1972, pp. 273–279.

Lever, "Carbohydrate Determination With 4–Hydroxybenzoic Acid Hydrazide (PAHBAH): Effect of Bismuth On The Reaction", Analytical Biochemistry, 81, 1977, pp. 22–27.

Gormsen, et al., "Lipolase, A Microbial Lipase For Detergents", 21st Detergent Symposium, JOCS, Novo–Nordisk a/s, Novo Alle, Bagsvaerd, Denmark, Oct. 19–20, 1989, pp. 1–7.

*Primary Examiner*—Kery Fries

*Attorney, Agent, or Firm*—Ernest G. Szoke; Wayne C. Jaeschke; Steven J. Trzaska

[57] ABSTRACT

A cleaning composition containing: (a) from about 1 to about 60% by weight of a surfactant component consisting essentially of: (i) a fatty alkyl ether sulfate; (ii) a linear alcohol ethoxylate; and (iii) a nonionic sugar surfactant, having a ratio by-weight of (i):(ii):(iii) in a range of about 0.5 to 1.0:1.5 to 2.5:0.5 to 1.5; and (b) from about 0.1 to about 10% by weight of an enzyme component selected from the group consisting of proteases, amylases, lipases, cellulases, peroxidases, and mixtures thereof, all weights being based on the weight of the composition.

48 Claims, 7 Drawing Sheets

PROTEASE STABILITY AFTER 28 DAYS AT 40° C.

FIGURE 1. PROTEASE STABILITY AFTER 28 DAYS AT 40° C.
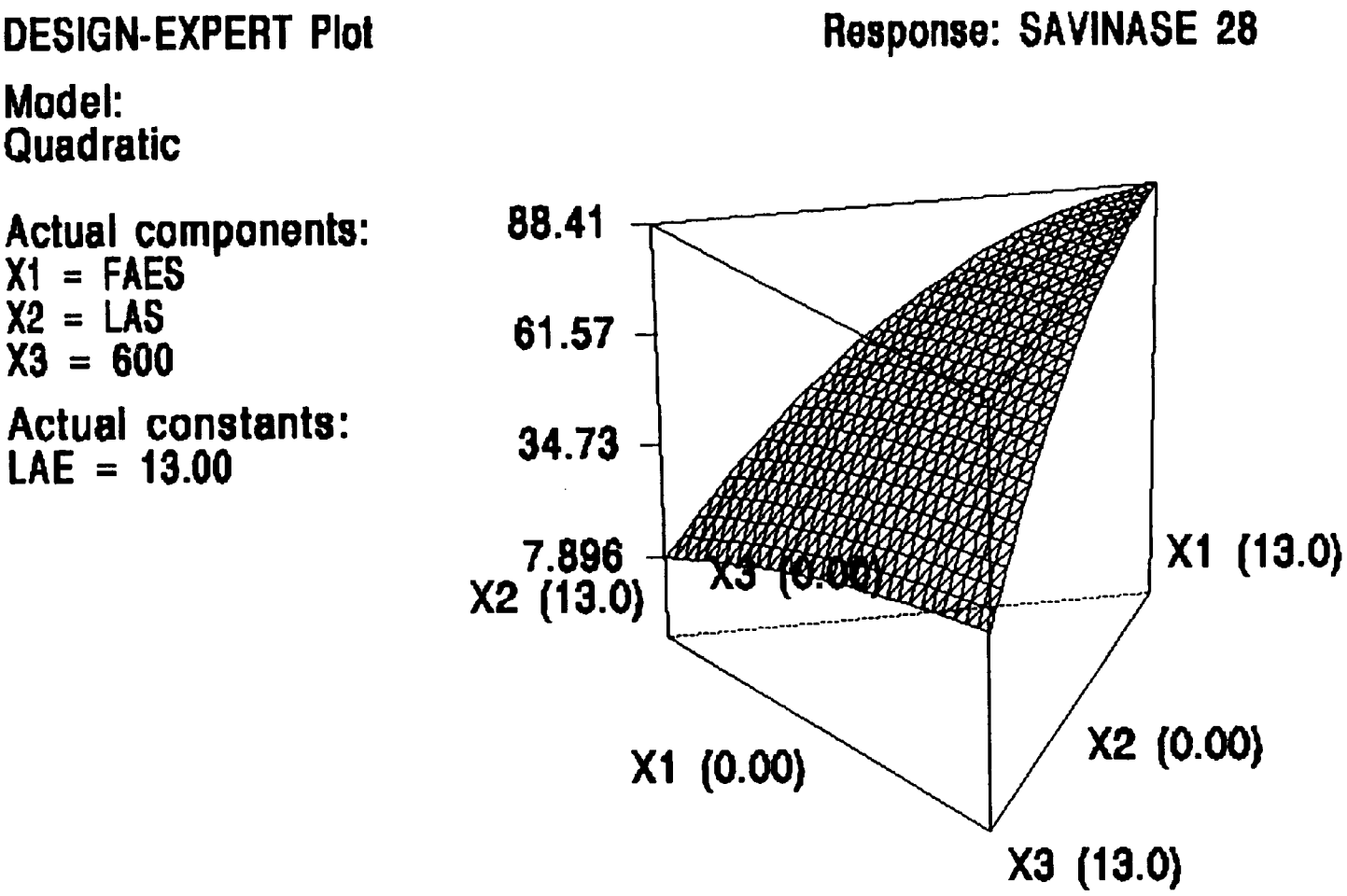

FIGURE 2. LIPASE STABILITY AFTER 28 DAYS AT 40°C.
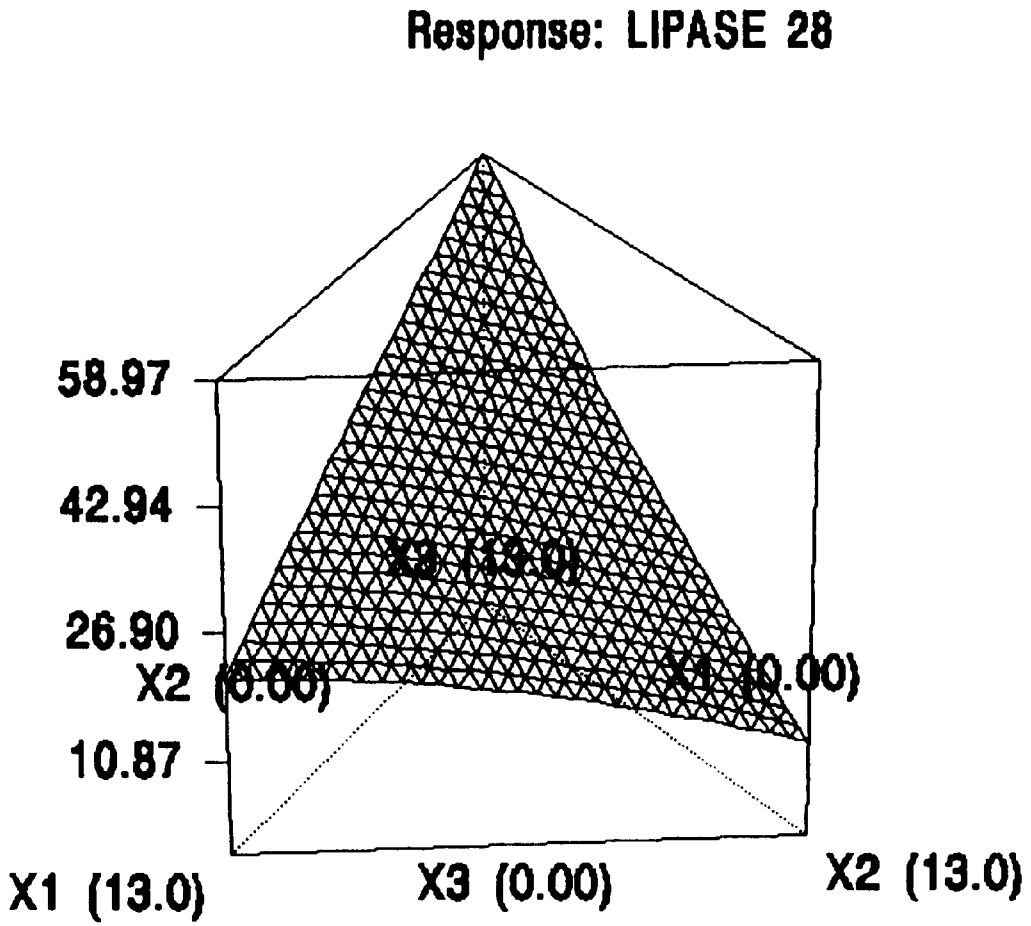

FIGURE 3. CELLULASE STABILITY AFTER 28 DAYS AT 40° C.
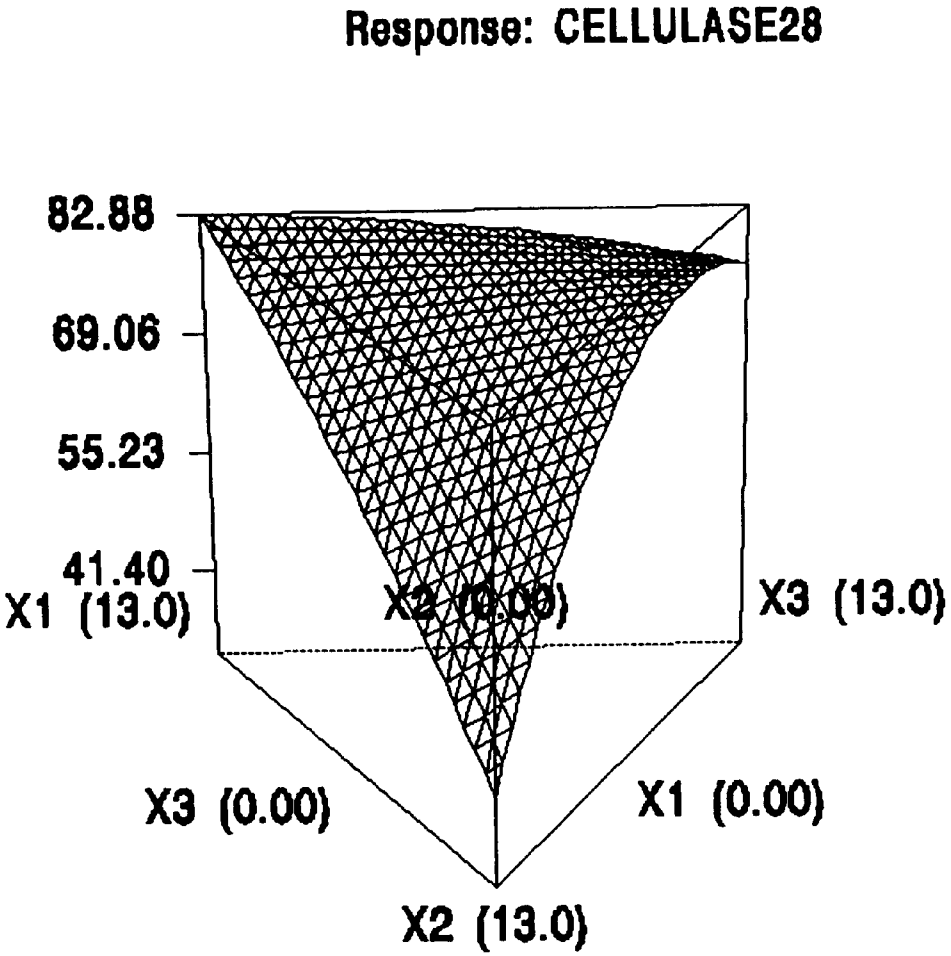

FIGURE 4. OPTIMIZED SURFACTANT COMPOSITION FOR PROTEASE AND LIPASE.
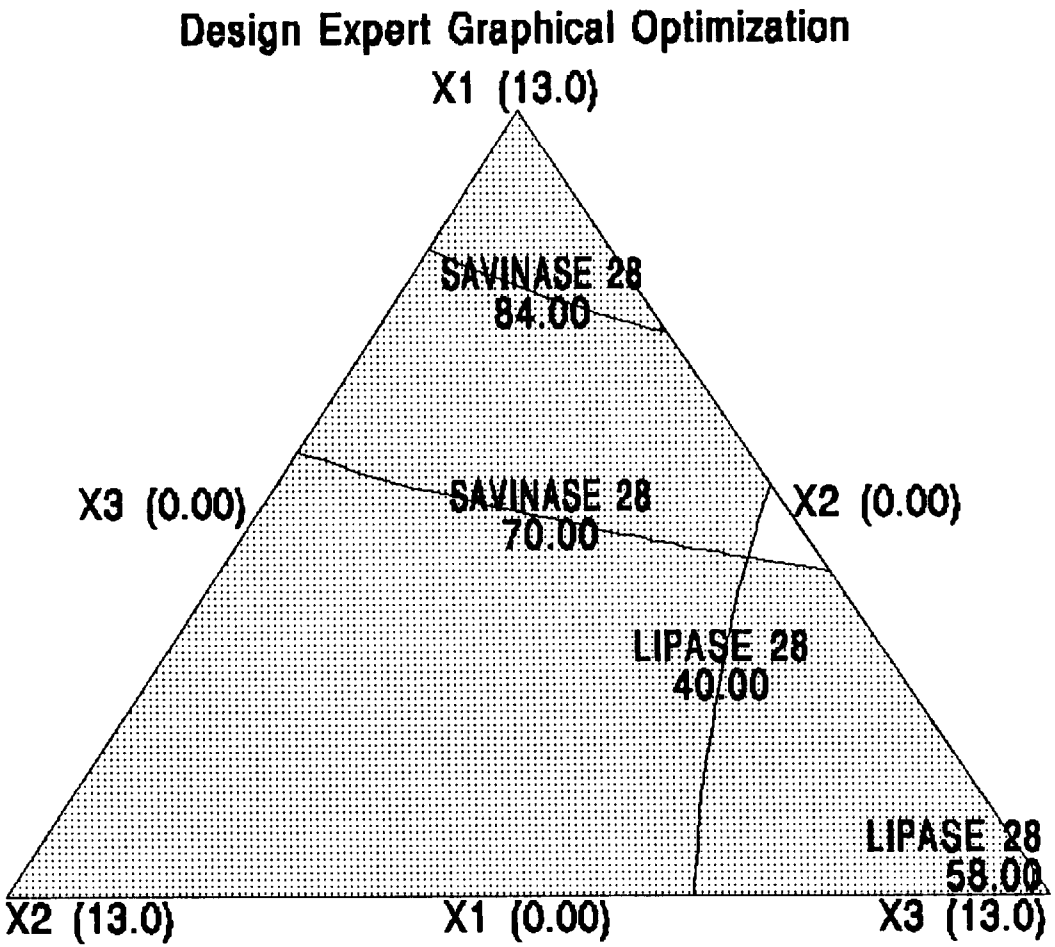

FIGURE 5. OPTIMIZED SURFACTANT COMPOSITION FOR PROTEASE AND CELLULASE.
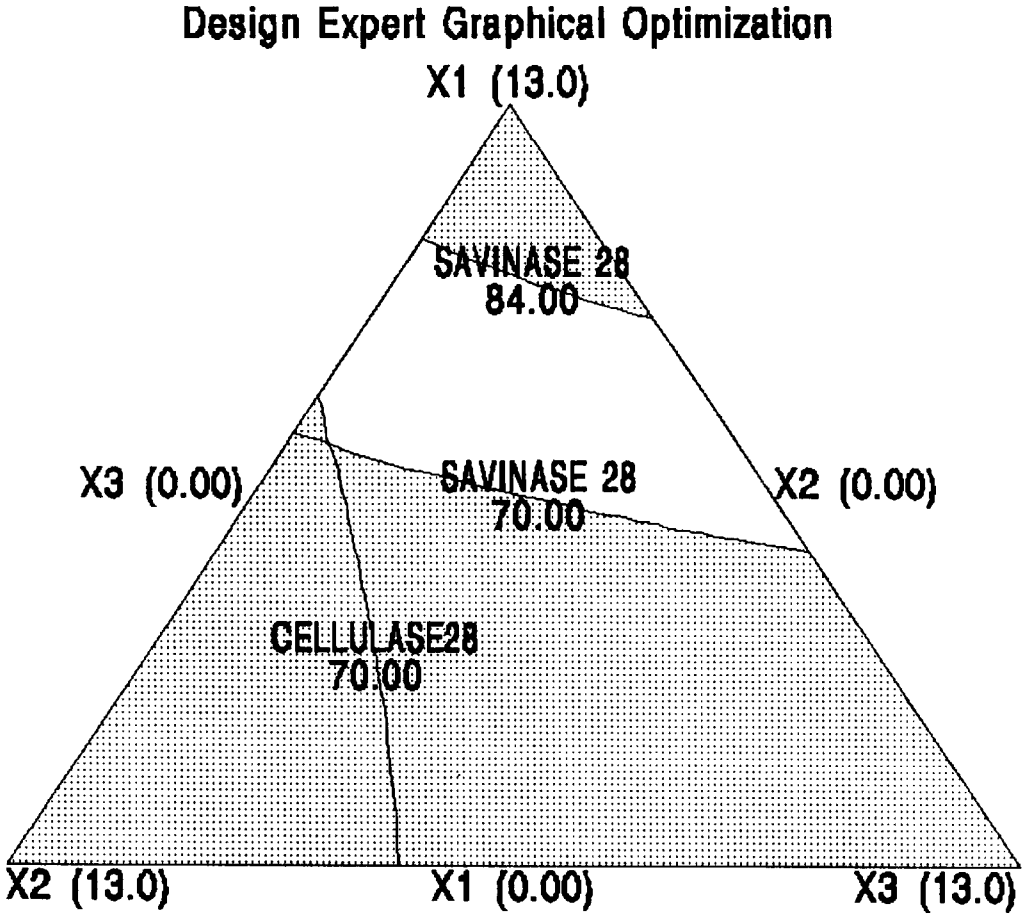

FIGURE 6. OPTIMIZED SURFACTANT COMPOSITION FOR LIPASE AND CELLULASE.
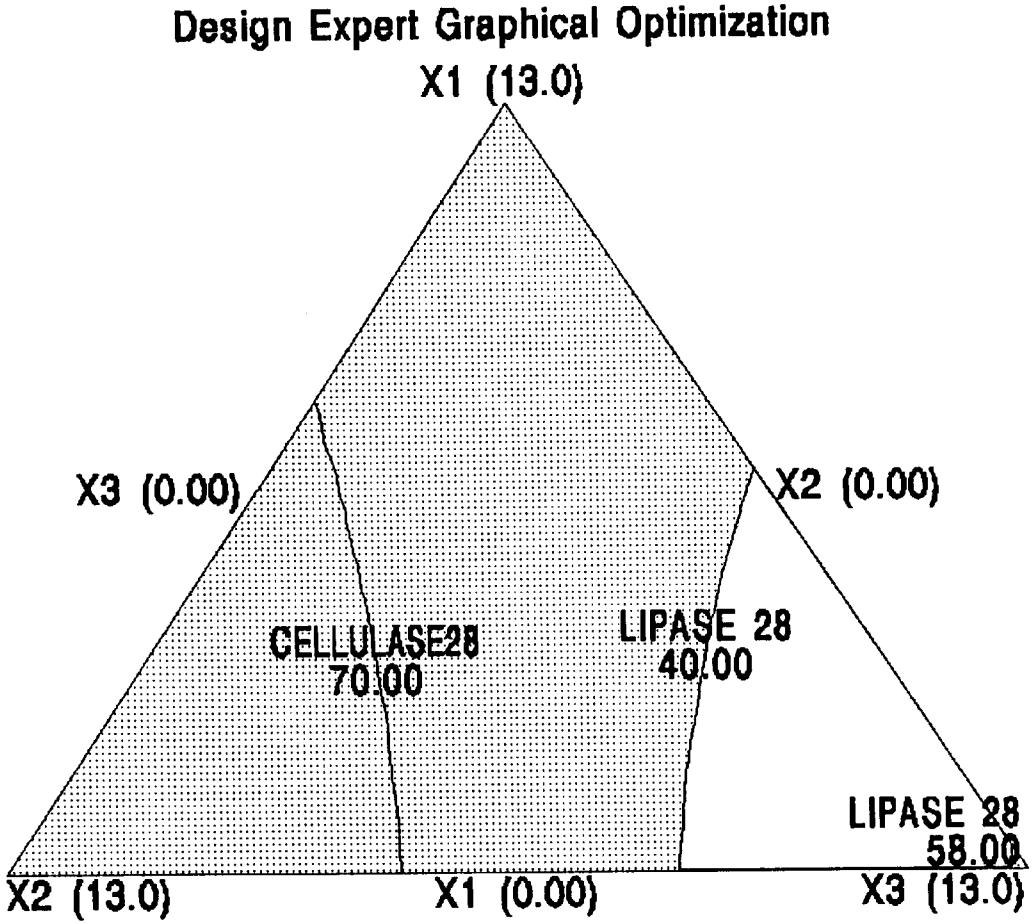

FIGURE 7. OPTIMIZED SURFACTANT FORMULATION FOR PROTEASE, LIPASE AND CELLULASE.
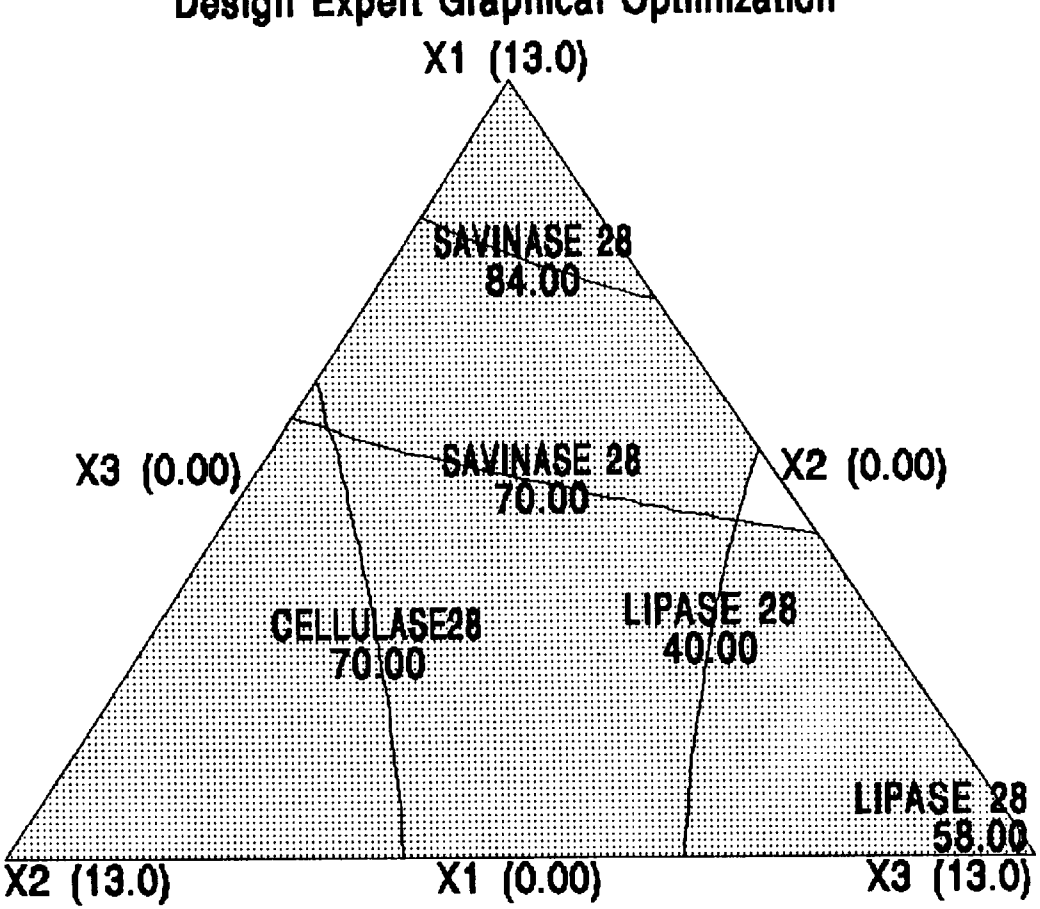

CLEANING COMPOSITIONS HAVING ENHANCED ENZYME ACTIVITY

FIELD OF THE INVENTION

The present invention generally relates to a cleaning composition having enhanced enzyme activity and stability. More particularly, by adding an effective amount of an alkyl polyglycoside to a cleaning composition having a predetermined amount of enzyme contained therein, the enzyme activity and stability of the cleaning composition is enhanced.

BACKGROUND OF THE INVENTION

Enzymes have long been used in the detergent arts to enhance the cleaning of textile substrates. Specific stains on soiled fabrics are particularly responsive to enzymes which cleave specific linkages in the molecules of the stain. For example, enzymes such as proteases and lipases are effective for removing stains such as blood and oils from textile substrates. These stains are protein and lipid fractions from food and fats such as are deposited from body soil. The action of the enzyme on the particular stain assists the surfactant to render overall cleaning improvement.

A particular difficulty associated with working with enzymes is that when they are presented in the form of powders, there have been instances of sensitization to the enzyme in selected individuals. To avoid contact with the enzymes, it has been proposed that the detergent products containing the same be prepared in the form of a liquid, thus minimizing the presence of any dust which may contain the enzyme. However, liquid detergent formulations containing enzymes cause problems relating to the stability of the enzyme. The problem associated with placing enzymes in a liquid environment is that they are subject to decomposition, either by surfactant denaturation or by self-digestion (proteolysis). It is therefore a problem to stabilize enzymes over extended periods of time, particularly when they are exposed to heat which further reduces enzyme stability.

It is therefore desirable to obtain a cleaning composition in a liquid or solid form in which the enzyme contained therein is stabilized such that enhanced synergistic cleaning performance is obtained.

SUMMARY OF THE INVENTION

The present invention provides a cleaning composition containing:

(a) from about 1 to about 60% by weight of a surfactant blend, the blend containing:
  (i) an alkyl ether sulfate surfactant;
  (ii) a linear alcohol ethoxylate surfactant; and
  (iii) a nonionic sugar surfactant, wherein surfactants (i)–(iii) are present in the blend in a ratio by weight of (i):(ii):(iii) of about 1:2:1; and (b) from about 0.1 to about 10% by weight of an enzyme selected from the group consisting of protease, amylase, lipase, cellulase, peroxidase, and mixtures thereof, all weights being based on the weight of the composition.

The present invention also provides a process for cleaning textile substrates involving contacting the textile substrates with the above-disclosed cleaning composition.

The present invention also provides a process for making a cleaning composition having enhanced enzyme stability involving:

(a) providing from about 1 to about 60% by weight of a surfactant blend, the blend containing:
  (i) an alkyl ether sulfate surfactant;
  (ii) a linear alcohol ethoxylate surfactant; and
  (iii) a nonionic sugar surfactant, wherein surfactants (i)–(iii) are present in the blend in a ratio by weight of (i):(ii):(iii) of about 1:2:1;

(b) providing from about 0.1 to about 10% by weight of an enzyme selected from the group consisting of protease, amylase, lipase, cellulase, peroxidase, and mixtures thereof; and (c) combining (a) and (b) to form the composition, all weights being based on the weight of the composition.

BRIEF DESCRIPTION OF THE DRAWINGS

FIG. 1 is a phase diagram showing the stability of protease in a cleaning composition in accordance with the present invention after 28 days at 40° C.

FIG. 2 is a phase diagram showing the stability of lipase in a cleaning composition in accordance with the present invention after 28 days at 40° C.

FIG. 3 is a phase diagram showing the stability of cellulase in a cleaning composition in accordance with the present invention after 28 days at 40° C.

FIG. 4 is a phase diagram showing the stability of a protease and lipase in a cleaning composition in accordance with the present invention after 28 days at 40° C.

FIG. 5 is a phase diagram showing the stability of a protease and cellulase in a cleaning composition in accordance with the present invention after 28 days at 40° C.

FIG. 6 is a phase diagram showing the stability of a lipase and cellulase in a cleaning composition in accordance with the present invention after 28 days at 40° C.

FIG. 7 is a phase diagram showing the stability of protease, lipase and cellulase in a cleaning composition in accordance with the present invention after 28 days at 40° C.

DESCRIPTION OF THE INVENTION

Other than in the operating examples, or where otherwise indicated, all numbers expressing quantities of ingredients or reaction conditions used herein are to be understood as being modified in all instances by the term "about".

Suitable nonionic sugar surfactants include, for example, alkyl polyglycosides and polyhydroxy fatty acid amides ("glucamides"). The polyhydroxy fatty acid amides which may be used in the present invention correspond to formula I:

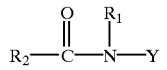

(I)

wherein: $R_1$ is H, $C_1$–$C_4$ hydrocarbyl, 2-hydroxy ethyl, 2-hydroxy propyl, or a mixture thereof, preferably $C_1$–$c_4$ alkyl, more preferably $C_1$ or $C_2$ alkyl, most preferably $C_1$ alkyl (i.e., methyl); and $R_2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Y is a polyhydroxyhydrocarbyl moiety having a linear hydrocarbyl chain with at least 3 hydroxyls directly connected to the chain, or an alkoxylated derivative (preferably ethoxylated or propoxylated) thereof. Y preferably will be derived from a reducing sugar in a reductive amination reaction; more preferably Y is a glycityl moiety.

Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Y. It should be understood that it is by no means intended to exclude other suitable raw materials. Y preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or poly-saccharide, and alkoxylated derivatives thereof. Most preferred are glycityls wherein n is 4, particularly $—CH_2—(CHOH)_4—CH_2OH$. Compounds of the formula I are also known as glucamides. Therefore, when, for example, $R_1$ is methyl, $R_2$ dodecyl; and Y is $—CH_2—(CHOH)_4—CH_2OH$, the compound in question is referred to as dodecyl N-methylglucamide.

Methods for making polyhydroxy fatty acid amides are known in the art. In general, polyhydroxy fatty acid amides can be made by reductively aminating a reducing sugar reacting with an alkyl amine to form a corresponding N-alkyl polyhydroxyamine and then reacting the N-alkyl polyhydroxyamine with a fatty aliphatic ester or triglyceride to form the N-alkyl, polyhydroxy fatty acid amide.

The alkyl polyglycosides which can be used in the cleaning compositions according to the invention correspond to formula II:

$$R_1O(R_2O)_b(Z)_a \quad \text{(II)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa. 19002. Examples of such surfactants include but are not limited to:

1. GLUCOPON® 220 Surfactant—an alkyl polyglycoside in which the alkyl group contains 8 to 10 carbon atoms and having an average degree of polymerization of 1.5.
2. GLUCOPON® 225 Surfactant—an alkyl polyglycoside in which the alkyl group contains 8 to 10 carbon atoms and having an average degree of polymerization of 1.7.
3. GLUCOPON® 600 Surfactant—an alkyl polyglycoside in which the alkyl group contains 12 to 16 carbon atoms and having an average degree of polymerization of 1.4.
4. GLUCOPON® 625 Surfactant—an alkyl polyglycoside in which the alkyl group contains 12 to 16 carbon atoms and having an average degree of polymerization of 1.4.
5. APG® 325 Surfactant—an alkyl polyglycoside in which the alkyl group contains 9 to 11 carbon atoms and having an average degree of polymerization of 1.6.
6. PLANTAREN® 2000 Surfactant—an alkyl polyglycoside in which the alkyl group contains 8 to 16 carbon atoms and having an average degree of polymerization of 1.4.
7. PLANTAREN® 1300 Surfactant—an alkyl polyglycoside in which the alkyl group contains 12 to 16 carbon atoms and having an average degree of polymerization of 1.6.
8. AGRIMUL® PG 2067 Surfactant—an alkyl polyglycoside in which the alkyl group contains 8 to 10 carbon atoms and having an average degree of polymerization of 1.7.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

In a particularly preferred embodiment, the nonionic sugar surfactant is an alkyl polyglycoside corresponding to formula II wherein $R_1$ is a monovalent organic radical having from about 8 to about 16 carbon atoms, b is zero, and a is a number having a value of from 1 to about 3.

The alkyl ether sulfates which may be employed in the present invention correspond to formula III:

$$R_1O—(CH_2CH_2O)_n—SO_3X \quad \text{(III)}$$

wherein $R_1$ is a linear or branched alkyl or alkenyl radical having from about 8 to about 16 carbon atoms, n is a number from 1 to 10, and X is an alkali metal or alkaline earth metal. A particularly preferred alkyl ether sulfate for use in the present invention is SULFOTEX® NL60-S, a coconut mid-cut ether sulfate having 2 moles of ethylene oxide.

The linear alcohol ethoxylates which may be employed in the present invention can be either straight-chain or branched alcohols with 8 to 16 carbon atoms which are ethoxylated with from about 1 to about 10 moles of ethylene oxide. Their derivation is well known in the art.

In a particularly preferred embodiment of the present invention, the linear alcohol ethoxylate is a straight-chain $C_{12}$–$C_{16}$ alcohol ethoxylated with about 6 to about 7 moles of ethylene oxide.

The cleaning composition of the present invention also contains from about 0.1 to about 10% by weight, and preferably about 0.5 to about 1.5% by weight of a detersive enzyme component. Suitable enzymes include proteases, amylases, lipases, cellulases, peroxidases, as well as mixtures thereof, all of which are employed on a pure enzyme basis. In a preferred embodiment, however, bacterial enzymes such as amylases and proteases, and fungal enzymes such as cellulases are employed in the cleaning composition. In a particularly preferred embodiment, the cleaning composition contains an enzyme component containing a mixture of a protease, cellulase and lipase.

Examples of suitable lipases for use herein include those of animal, plant, and microbiological origin. Although only limited studies on lipase distribution in plants have been conducted, suitable lipase enzymes are present in cambium, bark, and in plant roots. In addition, lipases have been found in the seeds of fruit, oil palm, lettuce, rice, bran, barley and malt, wheat, oats and oat flour, cotton tung kernels, corn, millet, coconuts, walnuts, fusarium, cannabis and cucurbit.

Suitable lipases are also found in many strains of bacteria and fungi. For example, lipases suitable for use herein can be derived from Pseudomonas, Aspergillus, Pneumococcus, Staphylococcus, and Staphylococcus Toxins, Mycobacterium Tuberculosis, Mycotorula Lipolytica and Sclerotinia microorganisms.

Suitable animal lipases are found in the body fluids and organs of many species. Most organs of mammals contain lipases, buth in addition, the enzymes are found in several digestive juices as well as in pancreatic juice.

Amylases suitable for use in the present cleaning composition include, for example, α-amylases obtained from a special strain of B.licheniforms. Amylolitic proteins include, for example, RAPIDASE®, available from International Bio-Synthetics, Inc. and TERMAMYL®, available from Novo Industries.

Cellulases which may be employed herein include both bacterial and fungal cellulases. Examples include cellulases produced by a strain of Humicola insolens (Humicola grisea var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Peroxidase enzymes are used in combination with oxygen sources, e.g., percarbonate, perborate, persulfate, hydrogen peroxide, etc. They are typically used for "solution bleaching", i.e. to prevent the transfer of dyes or pigments removed from textile substrates during washing operations to other substrates in the wash solution. Peroxidase enzymes are known in the art, and include, for example, horseradish peroxidase, ligninase, and haloperoxidase such as chloro- and bromo-peroxidase.

Suitable proteolytic enzymes for use in the cleaning composition of the present invention are of vegetable, animal, bacterial, mold and fungal origin. Examples of proteases which may be employed in the cleaning composition of the present invention are the subtilisins which are obtained from particular strains of B.subtilis and B.licheniforms. Another suitable protease is obtained from a strain of Bacillus, having maximum activity throughout the pH range of 8–12, developed and sold by Novo Industries A/S under the registered trade name ESPERASE®.

Of particular interest in the category of proteolytic enzymes are the alkaline proteases derived from Bacillus lentus hereinafter referred to as BLAP, as disclosed in U.S. Pat. No. 5,352,604, the entire contents of which is hereby incorporated by reference.

The surfactant blend, as previously discussed, is employed in the present composition in an amount of from about 1 to about 60% by weight, and preferably from about 5 to about 50% by weight, and most preferably from about 15 to about 30% by weight, based on the weight of the cleaning composition. The ratio by weight of fatty alkyl ether sulfate:linear alcohol ethoxylate:nonionic sugar surfactant is in the range of from about 0.5 to 1.0:1.5 to 2.5:0.5 to 1.5. In a particularly preferred embodiment, the ratio by weight is about 1:2:1.

The enzyme component employed herein is present in the cleaning composition in an amount of from about 0.1 to about 10%, and preferably from about 0.5 to about 1.5% by weight, based on the weight of the composition. The enzyme component preferably consists of a mixture of protease, lipase and cellulase.

According to one embodiment of the invention, there is provided a cleaning composition containing: (a) from about 15 to about 30% by weight of a surfactant component consisting essentially of: (i) a fatty alkyl ether sulfate, (ii) a linear alcohol ethoxylate, and (iii) an alkyl polyglycoside, in a ratio by weight of (i):(ii):(iii) of about 1:2:1; and (b) from about 0.5 to about 1.5% by weight, of an enzyme component consisting essentially of mixture of a protease, a lipase and a cellulase.

The cleaning composition of the present invention may also contain auxiliary components selected from the group consisting of other anionic surfactants, other nonionic detergent surfactants, cationic surfactants, amphoteric and zwitterionic surfactants, detergent builders, bleaching agents, bleaching activators, polymeric soil release agents, chelating agents, anti-redeposition agents, polymeric dispersing agents, optical brighteners, foam inhibitors, carriers, hydrotropes, processing aids, dyes, pigments, solvents for liquid formulations, and mixtures thereof.

The present invention also provides a process for cleaning textile substrates involving contacting the textile substrates with above-disclosed cleaning composition.

The present invention also provides a process for making a cleaning composition having enhanced cleaning properties involving: (a) providing from about 1 to about 60% by weight, preferably from about 5 to about 50% by weight, and most preferably from about 15 to about 30% by weight, of a surfactant blend, the blend containing: (i) an alkyl ether sulfate surfactant; (ii) a linear alcohol ethoxylate surfactant; and (iii) a nonionic sugar surfactant, wherein the ratio by weight of (i):(ii):(iii) is about 1:2:1; (b) providing from about 0.5 to about 1.5% by weight of an enzyme component consisting essentially of a mixture of a protease, a lipase, and a cellulase; and (c) combining (a) and (b) to form the composition, all weights being based on the weight of the composition.

The present invention will be better understood from the examples which follow, all of which are intended to be illustrative only and not meant to unduly limit the scope of the invention. Unless otherwise indicated, percentages are on a weight-by-weight basis.

EXAMPLES

To test the effect of different surfactants on long term enzyme stability in a formulated liquid detergent, an experimental design approach was used. Detergent samples were prepared using a combination of different surfactants holding the surfactant activities constant at 26%. In this work, three different types of enzymes were used. The activity of each enzyme in the formulation was determined at time zero and as a function of time at elevated temperature (40° C.). The stability of each enzyme is expressed in percentage units based on the initial enzyme activity.

The formulation and the range for each component is given in Table 1 below. EMERY® 625 is a coconut fatty acid used for foam control. Monoethanolamine is used to neutralize the fatty acid and as an alkalinity source. Propylene glycol/sodium borate is added to help stabilize the enzymes. The enzymes are added to the propylene glycol/sodium borate mixture prior to addition to the detergent base. The pH of the formulated detergent is adjusted to 8.5 prior to adding the enzymes.

TABLE 1

Liquid Detergent Formulation for Experimental Design Experiments

| Ingredients | Weight Percent |
|---|---|
| SULFOTEX ® NL60-S | 0–19% |
| BIOSOFT ® D-40 | 0–19% |
| NEODOL ® 25-7 | 0–13% |
| GLUCOPON ® 600UP | 0–13% |
| EMERY ® 625 | 4.0% |
| Monoethanolamine | 1.0% |
| Sodium Sulfate | 0.1% |
| Ethanol | 4.5% |
| Propylene Glycol/ Sodium Borate (7/1) | 15% |
| SAVINASE ® 16L | 0.75% |
| LIPOLASE ® 100L | 0.75% |
| CAREZYME ® | 0.75% |

SULFOTEX ® NL60-S = 60% FAES supplied by Henkel Corp.
BIOSOFT ® D-40 = 40% LAS supplied by Stepan
NEODOL ® 25-7 = 100% LAE supplied by Shell Chemical
GLUCOPON ® 600UP = 50% APG supplied by Henkel Corp.
EMERY ® 625 = a coconut fatty acid supplied by Henkel Corp.
SAVINASE ® 16L = solution grade protease supplied by Novo Nordisk
LIPOLASE ® 100L = solution grade lipase supplied by Novo Nordisk
CAREZYME ® = solution grade cellulase supplied by Novo Nordisk The stability of protease after 28 days at 40° C. is shown in FIG. 1. The stability of the enzyme is given along the z axis while the xy base plane gives the surfactant composition. For protease, enzyme activity increases with increasing concentration of FAES and decreases with increasing concentration of LAS. Increasing the concentration of GLUCOPON® 600UP in the blend gives a slight improvement in enzyme stability.

The stability of lipase after 28 days at 40° C. is shown in FIG. 2. For this system, enzyme stability increases with increasing concentration of LAE and APG and decreases with increasing concentration of FAES and LAS. It appears that anionic surfactants are effective at denaturing the protein.

The stability of cellulase at 28 days at 40° C. is shown in FIG. 3. For this system, enzyme stability increases with increasing concentration of FAES, LAE and APG and decreases with increasing concentration of LAS in the formulation.

To determine the optimum surfactant composition for multiple enzyme systems, the data from the design experiments was solved simultaneously. The optimum surfactant composition for protease and lipase is shown in FIG. 4. The unshaded area represents the surfactant blend ratio giving good stability for both enzymes. Based on this work, the optimum blend consists of FAES/LAE/APG=25%/50%/25%.

The optimum surfactant composition for protease and cellulase is given in FIG. 5. Again the unshaded region represents regions with good stability for both enzymes. Based on this work, the optimum surfactant blend ratio consists of FAES/LAE/APG/LAS=30%/50%/10%/10%.

The optimum surfactant composition for lipase and cellulase is given in FIG. 6. The optimum surfactant blend ratio consists of FAES/LAE/APG/LAS=10%/50%/35%/5%.

The optimum surfactant composition for protease, lipase and cellulase in given in FIG. 7. The optimum blend ratio consists of FAES/LAE/APG=25%/50%/25%.

What is claimed is:

1. A cleaning composition comprising:

(a) from about 1 to about 60% by weight of a surfactant component consisting essentially of:
  (i) a fatty alkyl ether sulfate;
  (ii) a linear alcohol ethoxylate; and
  (iii) a nonionic sugar surfactant, having a ratio by weight of (i):(ii):(iii) in a range of about 0.5 to 1.0:1.5 to 2.5:0.5 to 1.5; and (b) from about 0.1 to about 10% by weight of an enzyme component selected from the group consisting of proteases, amylases, lipases, cellulases, peroxidases, and mixtures thereof, all weights being based on the weight of the composition.

2. The composition of claim 1 wherein the nonionic sugar surfactant is selected from the group consisting of an alkyl polyglycoside corresponding to formula I:

$$R_1O(R_2O)_b(Z)_a \quad \text{(I)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, a polyhydroxy fatty acid amide, and mixtures thereof.

3. The composition of claim 2 wherein the nonionic sugar surfactant is an alkyl polyglycoside of formula I wherein $R_1$ is a monovalent organic radical having from about 8 to about 16 carbon atoms, b is zero, and a is a number having a value of from 1 to about 3.

4. The composition of claim 1 wherein the surfactant component is present in the composition in an amount of from about 15 to about 30% by weight, based on the weight of the composition.

5. The composition of claim 1 wherein the ratio by weight of (i):(ii):(iii) is about 1:2:1.

6. The composition of claim 1 wherein the enzyme component consists essentially of a protease, a lipase and a cellulase.

7. The composition of claim 1 wherein the enzyme component is present in the composition in an amount of from about 0.5 to about 1.5% by weight, based on the weight of the composition.

8. The composition of claim 1 wherein the composition further comprises an auxiliary component selected from the group consisting of other anionic surfactants, other nonionic surfactants, cationic surfactants, amphoteric and zwitterionic surfactants, detergent builders, bleaching agents, bleaching activators, polymeric soil release agents, chelating agents, anti-redeposition agents, polymeric dispersing agents, optical brighteners, foam inhibitors, carriers, hydrotropes, processing aids, dyes, pigments, solvents for liquid formulations, and mixtures thereof.

9. The composition of claim 1 wherein (i) is present in the surfactant blend in an amount of about 25% by weight, (ii) is present in the surfactant blend in an amount of about 50% by weight, and (iii) is present in the surfactant blend in an amount of about 25% by weight, all weights being based on the total weight of the surfactant blend.

10. The composition of claim 1 wherein the protease is BLAP.

11. The composition of claim 1 wherein the fatty alkyl ether sulfate is coconut mid-cut ether sulfate having about 2 moles of ethylene oxide.

12. The composition of claim 1 wherein the linear alcohol ethoxylate is a $C_{12}$–$C_{16}$ linear alcohol having from about 6 to about 7 moles of ethylene oxide.

13. A process for cleaning a textile substrate comprising contacting the textile substrate with a cleaning composition comprising:

(a) from about 1 to about 60% by weight of a surfactant component consisting essentially of:
  (i) a fatty alkyl ether sulfate;
  (ii) a linear alcohol ethoxylate; and
  (iii) a nonionic sugar surfactant, having a ratio by weight of (i):(ii):(iii) in a range of about 0.5 to 1.0:1.5 to 2.5:0.5 to 1.5; and (b) from about 0.1 to about 10% by weight of an enzyme component selected from the group consisting of proteases, amylases, lipases, cellulases, peroxidases, and mixtures thereof, all weights being based on the weight of the composition.

14. The process of claim 13 wherein the nonionic sugar surfactant is selected from the group consisting of an alkyl polyglycoside corresponding to formula I:

$$R_1O(R_2O)_b(Z)_a \quad \text{(I)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, a polyhydroxy fatty acid amide, and mixtures thereof.

15. The process of claim 14 wherein the nonionic sugar surfactant is an alkyl polyglycoside of formula I wherein $R_1$ is a monovalent organic radical having from about 8 to about 16 carbon atoms, b is zero, and a is a number having a value of from 1 to about 3.

16. The process of claim 13 wherein the surfactant component is present in the composition in an amount of from about 15 to about 30% by weight, based on the weight of the composition.

17. The process of claim 13 wherein the ratio by weight of (i):(ii):(iii) is about 1:2:1.

18. The process of claim 13 wherein the enzyme component consists essentially of a protease, a lipase and a cellulase.

19. The process of claim 13 wherein the enzyme component is present in the composition in an amount of from about 0.5 to about 1.5% by weight, based on the weight of the composition.

20. The process of claim 13 wherein the composition further comprises an auxiliary component selected from the group consisting of other anionic surfactants, other nonionic surfactants, cationic surfactants, amphoteric and zwitterionic surfactants, detergent builders, bleaching agents, bleaching activators, polymeric soil release agents, chelating agents, anti-redeposition agents, polymeric dispersing agents, optical brighteners, foam inhibitors, carriers, hydrotropes, processing aids, dyes, pigments, solvents for liquid formulations, and mixtures thereof.

21. The process of claim 13 wherein (i) is present in the surfactant blend in an amount of about 25% by weight, (ii) is present in the surfactant blend in an amount of about 50% by weight, and (iii) is present in the surfactant blend in an amount of about 25% by weight, all weights being based on the total weight of the surfactant blend.

22. The process of claim 13 wherein the protease is BLAP.

23. The process of claim 13 wherein the fatty alkyl ether sulfate is coconut mid-cut ether sulfate having about 2 moles of ethylene oxide.

24. The process of claim 13 wherein the linear alcohol ethoxylate is a $C_{12}$–$C_{16}$ linear alcohol having from about 6 to about 7 moles of ethylene oxide.

25. A process for making a cleaning composition having enhanced enzyme stability comprising:

(a) providing from about 1 to about 60% by weight of a surfactant component consisting essentially of:
  (i) a fatty alkyl ether sulfate;
  (ii) a linear alcohol ethoxylate; and
  (iii) a nonionic sugar surfactant, having a ratio by weight of (i):(ii):(iii) in a range of about 0.5 to 1.0:1.5 to 2.5:0.5 to 1.5;

(b) providing from about 0.1 to about 10% by weight of an enzyme component selected from the group consisting of proteases, amylases, lipases, cellulases, peroxidases, and mixtures thereof, all weights being based on the weight of the composition; and (c) mixing (a) and (b) to form the composition.

26. The process of claim 25 wherein the nonionic sugar surfactant is selected from the group consisting of an alkyl polyglycoside corresponding to formula I:

$$R_1O(R_2O)_b(Z)_a \quad \text{(I)}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, a polyhydroxy fatty acid amide, and mixtures thereof.

27. The process of claim 26 wherein the nonionic sugar surfactant is an alkyl polyglycoside of formula I wherein $R_1$ is a monovalent organic radical having from about 8 to about 16 carbon atoms, b is zero, and a is a number having a value of from 1 to about 3.

28. The process of claim 25 wherein the surfactant component is present in the composition in an amount of from about 15 to about 30% by weight, based on the weight of the composition.

29. The process of claim 25 wherein the ratio by weight of (i):(ii):(iii) is about 1:2:1.

30. The process of claim 25 wherein the enzyme component consists essentially of a protease, a lipase and a cellulase.

31. The process of claim 25 wherein the enzyme component is present in the composition in an amount of from about 0.5 to about 1.5% by weight, based on the weight of the composition.

32. The process of claim 25 wherein the composition further comprises an auxiliary component selected from the group consisting of other anionic surfactants, other nonionic surfactants, cationic surfactants, amphoteric and zwitterionic surfactants, detergent builders, bleaching agents, bleaching activators, polymeric soil release agents, chelating agents, anti-redeposition agents, polymeric dispersing agents, optical brighteners, foam inhibitors, carriers, hydrotropes, processing aids, dyes, pigments, solvents for liquid formulations, and mixtures thereof.

33. The process of claim 25 wherein (i) is present in the surfactant blend in an amount of about 25% by weight, (ii) is present in the surfactant blend in an amount of about 50% by weight, and (iii) is present in the surfactant blend in an amount of about 25% by weight, all weights being based on the total weight of the surfactant blend.

34. The process of claim 25 wherein the protease is BLAP.

35. The process of claim 25 wherein the fatty alkyl ether sulfate is a coconut mid-cut ether sulfate having about 2 moles of ethylene oxide.

36. The process of claim 25 wherein the linear alcohol ethoxylate is a $C_{12}$–$C_{16}$ linear alcohol having from about 6 to about 7 moles of ethylene oxide.

37. The product of the process of claim 25.

38. The product of the process of claim 26.

39. The product of the process of claim 27.

40. The product of the process of claim 28.

41. The product of the process of claim 29.

42. The product of the process of claim 30.

43. The product of the process of claim 31.

44. The product of the process of claim 32.

45. The product of the process of claim 33.

46. The product of the process of claim 34.

47. The product of the process of claim 35.

48. The product of the process of claim 36.

* * * * *